US009968929B2

(12) United States Patent
Chen et al.

(10) Patent No.: US 9,968,929 B2
(45) **Date of Patent: *May 15, 2018**

(54) REACTION CASSETTE AND ASSAY DEVICE

(71) Applicant: APEX BIOTECHNOLOGY CORP., Hsinchu (TW)

(72) Inventors: Sz Hau Chen, Hsinchu (TW); Ming Chang Hsu, Hsinchu (TW); Ya Chun Wu, Hsinchu (TW); Tin En Lin, Hsinchu (TW)

(73) Assignee: APEX BIOTECHNOLOGY CORP., Hsinchu (TW)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/250,003

(22) Filed: Aug. 29, 2016

(65) Prior Publication Data

US 2017/0113218 A1 Apr. 27, 2017

Related U.S. Application Data

(60) Provisional application No. 62/246,847, filed on Oct. 27, 2015.

(51) Int. Cl.

| | |
|---|---|
| ***B01L 3/00*** | (2006.01) |
| ***B01F 15/00*** | (2006.01) |
| ***B01F 11/00*** | (2006.01) |
| ***B01F 15/02*** | (2006.01) |

(52) U.S. Cl.

CPC ..... *B01L 3/5023* (2013.01); *B01F 11/0002* (2013.01); *B01F 15/00883* (2013.01);

(Continued)

(58) Field of Classification Search

CPC ..... B01L 3/5023; B01L 3/502746; B01L 2400/086; B01L 3/502; B01L 3/50273;

(Continued)

(56) References Cited

U.S. PATENT DOCUMENTS 4,406,413 A * 9/1983 Houle ..... A01C 3/026 241/101.76
4,799,862 A * 1/1989 Davidson ..... B01F 3/04531 366/307

(Continued)

FOREIGN PATENT DOCUMENTS

FR 2918900 1/2009

OTHER PUBLICATIONS

Lin et al., "Mixing Enhancement of the Passive Microfluidic Mixer with J-Shaped Baffles in the Tee Channel", Biomedical Microdevices, vol. 9, No. 2, Apr. 2, 2007, pp. 215-221.

(Continued)

*Primary Examiner* — Sally A Merkling
(74) *Attorney, Agent, or Firm* — Liu & Liu

(57) ABSTRACT

A reaction cassette and a biochemical assay device are disclosed. The reaction cassette for biochemical assay comprises a housing with structural walls defining a liquid mixing space for accommodating at least one mixing zone, wherein the at least one mixing zones comprises at least one blending structures for generating a vortex phenomenon in liquid, thereby improving the degree of mixture of a liquid sample and a dried reagent.

13 Claims, 8 Drawing Sheets

(52) U.S. Cl.
CPC ..... *B01F 15/0295* (2013.01); *B01L 3/502* (2013.01); *B01L 3/50273* (2013.01); *B01L 3/502746* (2013.01); *B01L 3/502753* (2013.01); *B01L 2200/0605* (2013.01); *B01L 2200/0621* (2013.01); *B01L 2200/16* (2013.01); *B01L 2300/069* (2013.01); *B01L 2300/0816* (2013.01); *B01L 2300/12* (2013.01); *B01L 2400/0409* (2013.01); *B01L 2400/0457* (2013.01); *B01L 2400/086* (2013.01)

(58) Field of Classification Search
CPC ..... B01L 3/502753; B01L 2400/0409; B01L 2300/0816; B01L 2300/069; B01L 2200/0621; B01F 15/0295; B01F 11/0002; B01F 15/00883
See application file for complete search history.

(56) References Cited

U.S. PATENT DOCUMENTS 4,963,032 A * 10/1990 Strehlow ..... B01F 9/06 366/45
5,162,237 A 11/1992 Messenger et al.
5,518,311 A 5/1996 Althaus et al.
7,641,871 B2 1/2010 Futami et al.
2009/0134046 A1* 5/2009 Breidenthal ..... B01F 11/0045 206/221
2009/0263282 A1* 10/2009 Kageyama ..... B01L 3/502738 422/68.1
2013/0121898 A1 5/2013 Chen et al.
2014/0127828 A1 5/2014 Hou et al.
2015/0031071 A1 1/2015 Winther

OTHER PUBLICATIONS

Bhagat et al., "A Passive Planar Micromixer with Obstructions for Mixing at Low Reynolds Numbers", Journal of Micromechanics & Microengineering, Institute of Physics Publishing, Bristol, GB, vol. 17, No. 5, Apr. 17, 2007, pp. 1017-1024.
Wang et al., "Mixing Enhancement of a Passive Microfluidic Mixer Containing Triangle Baffles", Asia-Pacific Journal of Chemical Engineering, Jan./Feb. 2007, John Wiley & Sons Ltd., The Atrium GB, vol. 9, No. 6, Jul. 25, 2014, pp. 877-885.
European Search Report for Counterpart EP Application No. 16001962.

* cited by examiner

REACTION CASSETTE AND ASSAY DEVICE

CROSS REFERENCE TO RELATED APPLICATIONS

The present application claims priority to U.S. provisional Application No. 62/246,847 entitled "REACTION CASSETTE AND ASSAY DEVICE", filed on Oct. 27, 2015, which is incorporated herein by reference in its entirety for all purposes.

FIELD OF INVENTION

The present invention generally relates to reaction cassettes and assay devices, and more particularly, to reaction cassettes for biochemical assay with blending structures in mixing zones and assay devices using the reaction cassette.

BACKGROUND OF THE INVENTION

In vitro diagnostic (IVD) assay has been widely utilized in the qualitative and quantitative assessment of body fluid for providing information regarding diagnosis and therapy. For this reason, in vitro medical measurement plays a very important role and has become an increasingly important means in modern day's healthcare industry. Healthcare professionals observe changes of important physiological signals or detection indices in patients by qualitatively and quantitatively measuring changes in the body fluids, thereby rapidly diagnosing disease and providing treatment in accordance with the index information.

The abovementioned detection technologies require in conjunction with a variety of testing equipment and measuring instruments and various configurations of test solution. Generally, the detection device can be a micro channel biochemical test strip. The sample (e.g., blood) drags by capillary action into a reaction zone and reacts with a reagent thereof. This micro channel biochemical test strip, however, is a one-way system in the process of leading the sample into the reaction zone. As a result, the sample first into reaction zone will release most of the reagents, while that later into the reaction zone has insufficient mixable reagent.

On the other hand, some corporates in the industry take advantage of a reaction cassette as detection devices. The reagents are placed in the reaction cartridge. By controlling specific rotation angles of the reaction cassette and reaction time, the desired effect of detection can be achieved. However, most of the commercially available reaction cassettes adopt flow channels with flatted or curved of structure in order to allow smooth flow of the sample. The flow channels with flatted or curved of structure prone to causing problems of uneven mixing the sample with a reagent or incomplete dissolved solution.

SUMMARY OF THE INVENTION

According to an aspect of the present invention, a reaction cassette for biochemical assay comprises a housing with structural walls defining a liquid mixing space for accommodating at least one mixing zone, wherein the at least one mixing zones comprises at least one blending structures for generating a vortex phenomenon in liquid, thereby improving the degree of mixture of a liquid sample and a dried reagent.

The liquid mixing space comprises a first mixing zone configured to accommodate a mixture of a liquid and a reagent. The first mixing zone has rounding edges and corners, leading the liquid mixture to an optical detection zone. A second mixing zone is disposed in a direction perpendicular to the first mixing zone. A first inclined plane is disposed between the optical detection zone and the first mixing zone so that the liquid smoothly flows through. A third mixing zone is disposed in a direction perpendicular to the second mixing zone; a second inclined plane disposed between the second and the third mixing zones so that the liquid smoothly flows through. An absorption zone is disposed downstream of the third mixing zone, having a spill-proof wall disposed between the third mixing zone and the absorption zone, preventing the mixed liquid in the third mixing zone from overflowing into the absorption zone accident by accident. A housing defining a space for accommodating the first mixing zone, the second mixing zone, the third mixing zone, the optical detection zone and the absorption zone.

In some embodiments, the second and the third mixing zones comprise blending structures for accommodating dried reagents and improving the degree of mixture of the liquid sample and the dried reagents.

The blending structure comprises a first barrier wall, a second barrier wall, a structural wall and a spill-proof wall. The first and second barrier walls comprise a beveled outer wall, an inner wall, and a wall peak platform.

The blending structures comprise at least one arcuate blade, generating an arcuate flow of the liquid in accordance with its structure so that part of the liquid creates a vortex phenomenon in the center of the arcuate blade. In another embodiment, the blending structures comprise at least one rhombic blade, generating an inclined flow of the liquid in accordance with its structure so that part of the liquid creates a vortex phenomenon due to a flow rate difference between a turn-back liquid and other liquid. In still another embodiment, the blending structures comprise at least one trapezoidal blade, generating an inclined flow of the liquid in accordance with its structure so that part of the liquid creates a vortex phenomenon due to a flow rate difference between a turn-back liquid and other liquid.

According to another aspect of the present invention, a biochemical assay device comprises a reaction cassette for biochemical assay, which includes a first mixing zone configured to accommodate a liquid. The first mixing zone has rounding edges and corners, leading the liquid to an optical detection zone. A second mixing zone is disposed in a direction perpendicular to the first mixing zone. A first inclined plane is disposed between the optical detection zone and the first mixing zone so that the liquid smoothly flows through. A third mixing zone is disposed in a direction perpendicular to the second mixing zone. A second inclined plane is disposed between the second and the third mixing zones so that the liquid smoothly flows through. An absorption zone is disposed downstream of the third mixing zone and has a spill-proof wall disposed between the third mixing zone and the absorption zone, thereby preventing the mixed liquid in the third mixing zone from overflowing into the absorption zone accident by accident. A housing defines a space for accommodating the first mixing zone, the second mixing zone, the third mixing zone, the optical detection zone and the absorption zone; wherein the second and the third mixing zones comprise blending structures for accommodating dried reagents and improving the degree of mixture of the liquid sample and the dried reagents. A sampling part that is configured to be inserted to the reaction cassette comprises a sampling tube, which is configured to draw a liquid sample, and a reservoir configured to store a liquid reagent.

The other aspects of the present invention, part of them will be described in the following description, part of them will be apparent from description, or can be known from the execution of the present invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE PICTURES

The foregoing aspects and many of the attendant advantages of this invention will become more readily appreciated as the same becomes better understood by reference to the following detailed description, when taken in conjunction with the accompanying pictures, wherein.

DETAILED DESCRIPTION OF THE INVENTION

Figure 1:
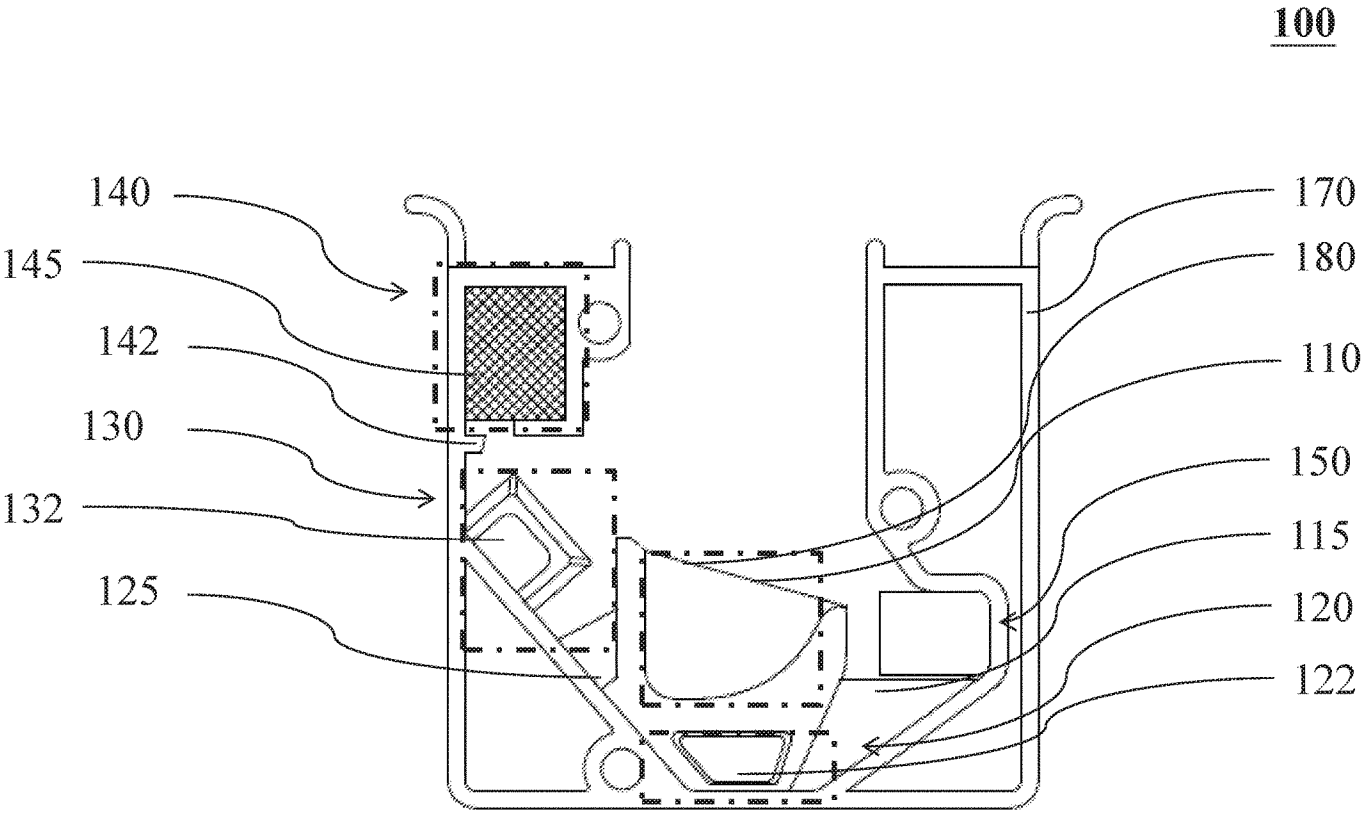
FIG. 1 is a schematic plan view of a reaction cassette according to an embodiment of the present invention.

The present invention discloses an assay device and an assay method using the same for carrying out the process of analyzing constituents of a liquid sample in a more convenient and safer manner. The present invention will be described more fully hereinafter with reference to the FIG. 1 to FIG. 7B. However, it should be noted that the features illustrated in the drawings are not necessarily drawn to scale, and like reference numerals represent the same or similar elements. The devices, elements, and methods in the following description are configured to illustrate the present invention, and should not be construed in a limiting sense.

FIG. 1 is a schematic plan view of a reaction cassette according to an embodiment of the present invention. As shown in FIG. 1, a reaction cassette 100 comprises a housing with structural walls 170 defining a liquid mixing space for accommodating at least one mixing zone. The liquid mixing space includes a first mixing zone 110, a second mixing zone 120, a third mixing zone 130, an optical detection zone 150 and an absorption zone 140. A housing defining a space for accommodating the first mixing zone, the second mixing zone, the third mixing zone, the optical detection zone and the absorption zone which have capability of receiving mixture of liquid and reagent respectively. Particularly, a first inclined plane 115 is disposed between the optical detection zone 150 and the first mixing zone 110 so that the liquid can smoothly flow through. A second inclined plane 125 is disposed between the second mixing zone 120 and third mixing zone 130 so that the liquid can smoothly flow through. A spill-proof wall 142 is disposed between the third mixing zone 130 and the absorption zone 140, preventing the mixed liquid in the third mixing zone 130 from overflowing into the absorption zone 140 accidentally. Furthermore, the first mixing zone 110 includes a first opening 180 and an arcuate corner structure configured to provide a liquid reagent completely smoothly flowing from the first reaction zone to the optical detection zone 150, thereby increasing the smoothness of the liquid flow. The second mixing zone 120 and the third mixing zone 130 comprise blending structures 122 capable of accommodating dried reagents and improving the degree of mixture of the liquid sample and the dried reagents. The reaction cassette 100 is preferably made of optical transparent material formed by injection molding. In order to reduce interference by the side light, surfaces of the reaction cassettes is performed mist finishing.

The absorption zone 140 includes a hollowed, non-densified structure with openings, in which the openings, for example, can be located below the absorption zone, facilitating absorption of the sample and reagents by an absorbent material 145. The absorbent material 145 may comprise a variety of materials having a high absorbency, such as cotton, sponges, diatomite, filter paper, etc.

Figure 2:
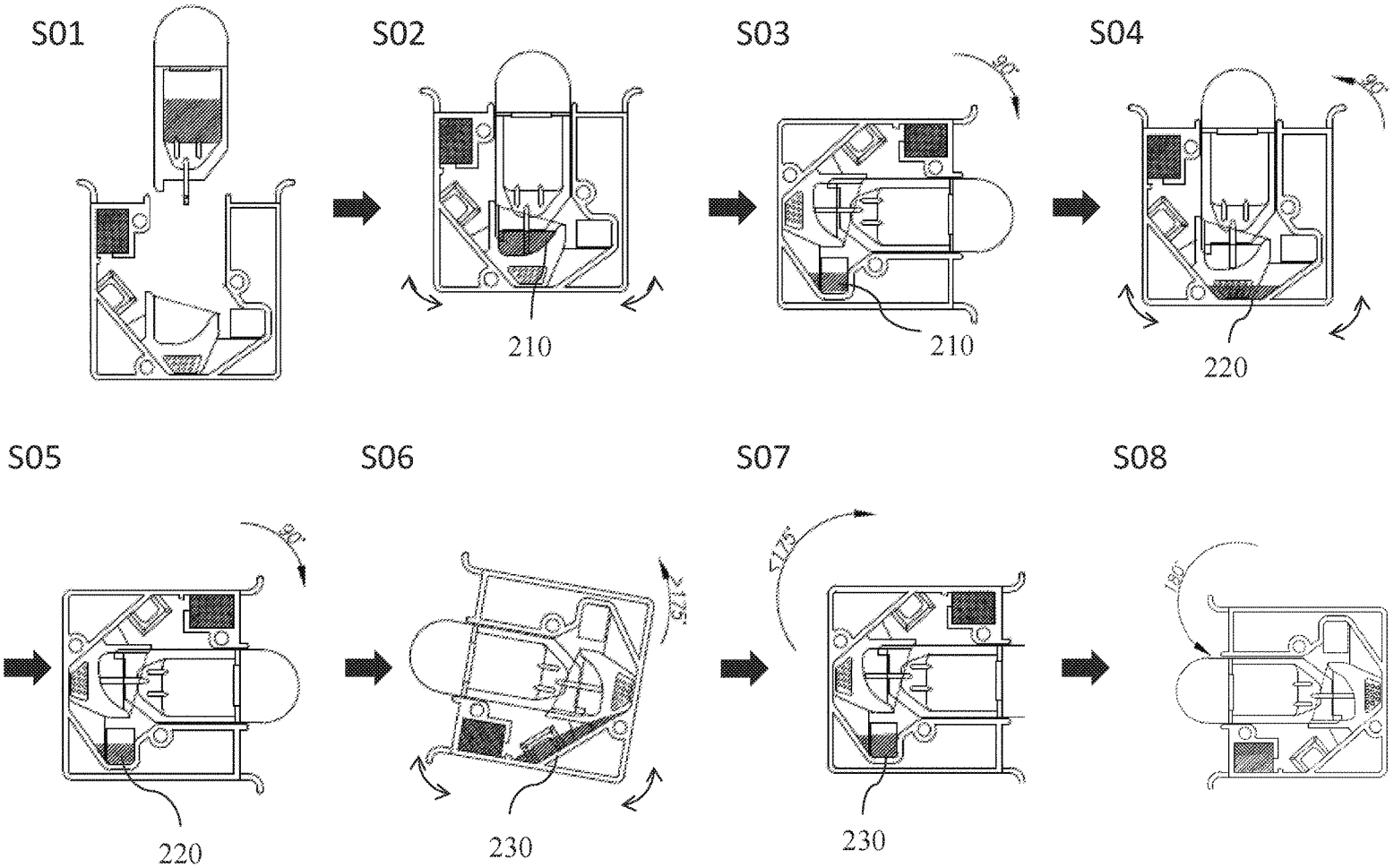
FIG. 2 is a schematic view illustrating respective steps for detecting the liquid sample performed by a detecting apparatus in accordance with the present invention.

FIG. 2 is a schematic view illustrating respective steps for detecting the liquid sample performed by a detecting apparatus in accordance with the present invention. First, with reference to step S01 the sample along with a liquid reagent stored in a sampling part is placed into a reaction cassette. After the sample and the liquid reagent flow into a first mixing zone of the reaction cassette, shake the reaction cassette as indicated in the step S02 so that a first mixture 210 is generated from uniformly mixing and reaction of the liquid reagent and the sample. Further referring to step S03, the reaction cassette is rotated clockwise about 90° so that the first mixture 210 flows from the first mixing zone into the optical detection zone of the reaction cassette, thereby acquiring a first concentration by using optical measurement.

Next, referring to step S04, the reaction cassette is rotated counterclockwise 90° so that the first mixture flows into the second mixing zone via the first inclined plane. After the reaction cassette is shaken, the first mixture 210 and the dried reagent in the second mixing zone are thoroughly mixed and reacted, thereby generation a second mixture 220. Further as shown in step S05, the reaction cassettes is rotated 90° clockwise so that the second mixture 220 flows into the optical detection zone again, thereby acquiring a second concentration by optical measurement.

Next, referring to step S06, the reaction cassette is rotated counterclockwise less than or equal to 175° so that the second mixture flows into the third mixing zone via the second inclined plane. After the reaction cassette is shaken, the second mixture and the dried reagent in the third mixing zone are thoroughly mixed and reacted, thereby generation a third mixture 230. In order to prevent the second mixture 220 or the third mixture 230 from overflowing to a recycling zone due to over-shaking, in one embodiment, a spill-proof wall is provided in the third mixing zone near the recycling zone. Further as shown in step S07, the reaction cassettes is rotated less than or equal to 175° clockwise so that the third mixture flows into the optical detection zone again, thereby acquiring a third concentration by optical measurement.

Finally as shown in step S08, the reaction cassette is rotated counterclockwise over 180° so that the third mixture flows into and is recycled by the absorbent material in the absorption zone of the reaction cassette. A concentration with medical significance can be calculated by using the first concentration, the second concentration and the third concentration. Note that in the aforementioned steps, the measured optical signals can be converted to electrical signals. Subsequent analysis and comparison process can thus be performed in order to calculate the ratio or concentration of a specific component in a liquid sample. Embodiments of the present invention do not intend to limit various angles of rotation and shack of the reaction cassette during the measurement process, only if the liquid sample and reagents can be smoothly mixed incorporated with the location of each mixing zones. Related mixing and measuring methods can refer to U.S. Pat. No. 8,617,490, titled "Reaction cassette, assay device, and assay method" and U.S. Pat. No. 8,802,036, titled "Reaction cassette and assay device" the entirety of which is incorporated herein by reference.

As shown in FIG. 2, as the liquid enters in the mixing zone, the reflecting cassette is shaken to facilitate mixing the dried agent with the liquid mixture. The liquid mixture fills part of the blending stniclure such that the blending structure of the present invention is presented as a vertical relationship with respect to the liquid surface while mixing. When shaking the reaction cassette from side-to-side, an obtained force in the liquid impacts the dried agent within the blending structure so that the dried agent is dissolved in the liquid and flows out the blending structure. In one embodiment, a first mixture is created based on mixing liquid samples with liquid medicament. A second mixture is created based on mixing the first mixture with the dried agent in the second mixing zone. A third mixture is created based on mixing the second mixture with the dried agent in the third mixing zone. The second mixture is more thickened compared with the first mixture such that the thick level of liquid will affect the capability to dissolve the dried agent. In order to improve the capability for the first and second mixtures dissolving and uniformly mixing the dried agent, a blending structure is particularly provided in the second and third mixing zone respectively with the dried agent contained therein. In order to simplify the description, the liquid samples, the first mixture, the second mixture and the third mixture are collectively referred to as the liquid mixtures in the following description. The second and third mixing zones are collectively referred to as the mixing zones.

Figure 3:
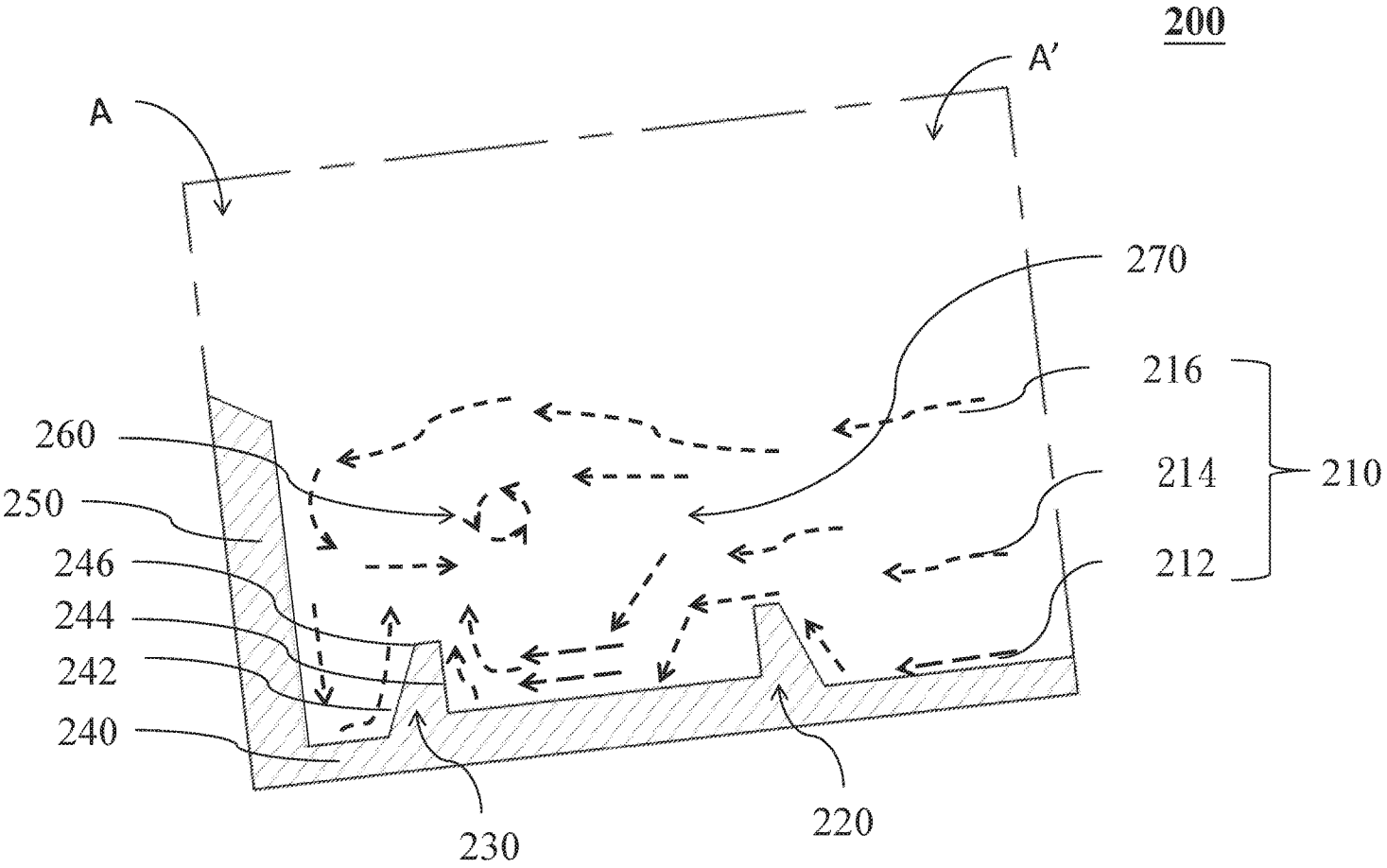
FIG. 3 is a schematic view of the liquid flow field while shaking the mixing zones.

FIG. 3 is a schematic view of the liquid flow field while shaking the mixing zones. Liquid 210 can be divided into a viscous layer 212, a transition layer 214 and turbulent layer 216 according to its shear stress effect on the structural wall 240. The viscous layer 212 is very thin, about 1% of the diameter of the liquid 210, wherein the intra-layered velocity distribution is approximately linear. The fluctuation of the turbulence would be disappeared because of confinement of the structural wall 240, so here is substantially a laminar flow. The flow rate of the viscous layer 212 is slow and steady compared to the transition layer 214 and the turbulent layer 216. The turbulent layer 216 is located at top of all liquid layers, wherein the shear stress exerted by the structural wall 240 is relatively small. However, the gravity suffered from shaking is relatively larger than those of fluids at the viscous layer 212 and transition layer 214 such that the flow rate of the turbulent layer 216 is more rapid and completely turbulent compared to liquid at other layers. The transition layer 214 is located between the viscous layer 212 and the turbulent layer 216, wherein its flow rate is ranged between those of the viscous layer 212 and the turbulent layer 216 and will be affected by both gravity and shear stress with the structural wall 240.

As shown FIG. 3, the blending structure 200 of some embodiments of the present invention comprises a first barrier wall 220, a second barrier wall 230, a structural wall 240 and a spill-proof wall 250. The first and second barrier walls 220, 230 comprise a beveled outer wall 242, an inner wall 244, and a wall peak platform 246. When the reaction cassette swings toward the right side and is presented as A' relatively higher than A, the liquid flows toward A due to gravity. As the liquid flows through the first barrier wall 220 of the blending structure 200, the originally smooth flow in the transition layer 214 is obstructed due to beveled outer wall 242, producing energy loss of the fluid and deriving pressure-drop. In the meantime, a spoiler is generated in the transition layer 214, part of the viscous layer 212 and the turbulent layer 216. However, the overall orientation of the liquid flow does not change until the liquid expands and crosses the beveled outer wall 242 reaching the wall peak platform 246. A height difference exists between the wall peak platform 246 and the structure wall 240 such that the liquid located at the wall peak platform 246 is subjected greater shear stress that at the structural wall 240, stabilizing liquid pressure at the transition layer 214. When the liquid expands over the wall peak platform 246, a height difference generates shear stress and gravity mutations causing overall force at the transition layer 214 generates being destructed and generating a separation phenomenon 270. Part of the transition layer 214 adjusting to the turbulent layer 216 is brought into the turbulent layer 216 accelerating toward point A. After the flow impacts the spill-proof wall 250, the spill-proof wall 250 generates an anti-gravity force forcing the flow orientation of the turbulent layer toward point A'. The turbulent layer 216 flows back to point A' causing confliction of the flow rate and flow orientation generating a vortex phenomenon 260 which is created in the vicinity of the second barrier wall 230.

Another part of the transition layer 214 adjacent to the viscous layer 212 accelerates and impacts the reagent (not shown) within the blending structure 200 and flows toward the second barrier wall 230. As the liquid in the transition layer 214 meets the obstruction of the inner wall 244 of the second barrier wall 230, the liquid flow of the transition layer 214 is forced bringing the reagent out of the blending structure 200 due to change of potential and increasing swirl energy of the vortex phenomenon 260. In the meantime, the reagent is brought from the liquid with high content to liquid with low content to proceed with mixed diffusion through the vortex phenomenon 260, thereby making the reagent uniformly distributed. If the reaction cassette begins swinging toward the left side, the potential of the liquid will change such that the flow direction of the liquid is opposites to the direction of vortex. Note that the width of the wall peak platform 246 of the present invention would not be intended to be limited. It would only require that the wall peak platform 246 can stabilize pressure of the transition layer and provide the transition layer 214 with a separation phenomenon 270. Preferably, the width of the wall peak platform 246 is about 0.25~6 mm. More preferably, the width of the wall peak platform 246 is about 0.1~3 mm. Moreover, the slope of the beveled outer wall 242 of the present invention would not be intended to be limited. It would only require that the liquid can expand and across. Preferably, the beveled outer wall 242 and the structural wall 240 include 5 to 80 degrees. More preferably, the beveled outer wall 242 and the structural wall 240 include 20 to 70 degrees. Even more preferably, the beveled outer wall 242 and the structural wall 240 include 30 to 50 degrees.

Figure 4:
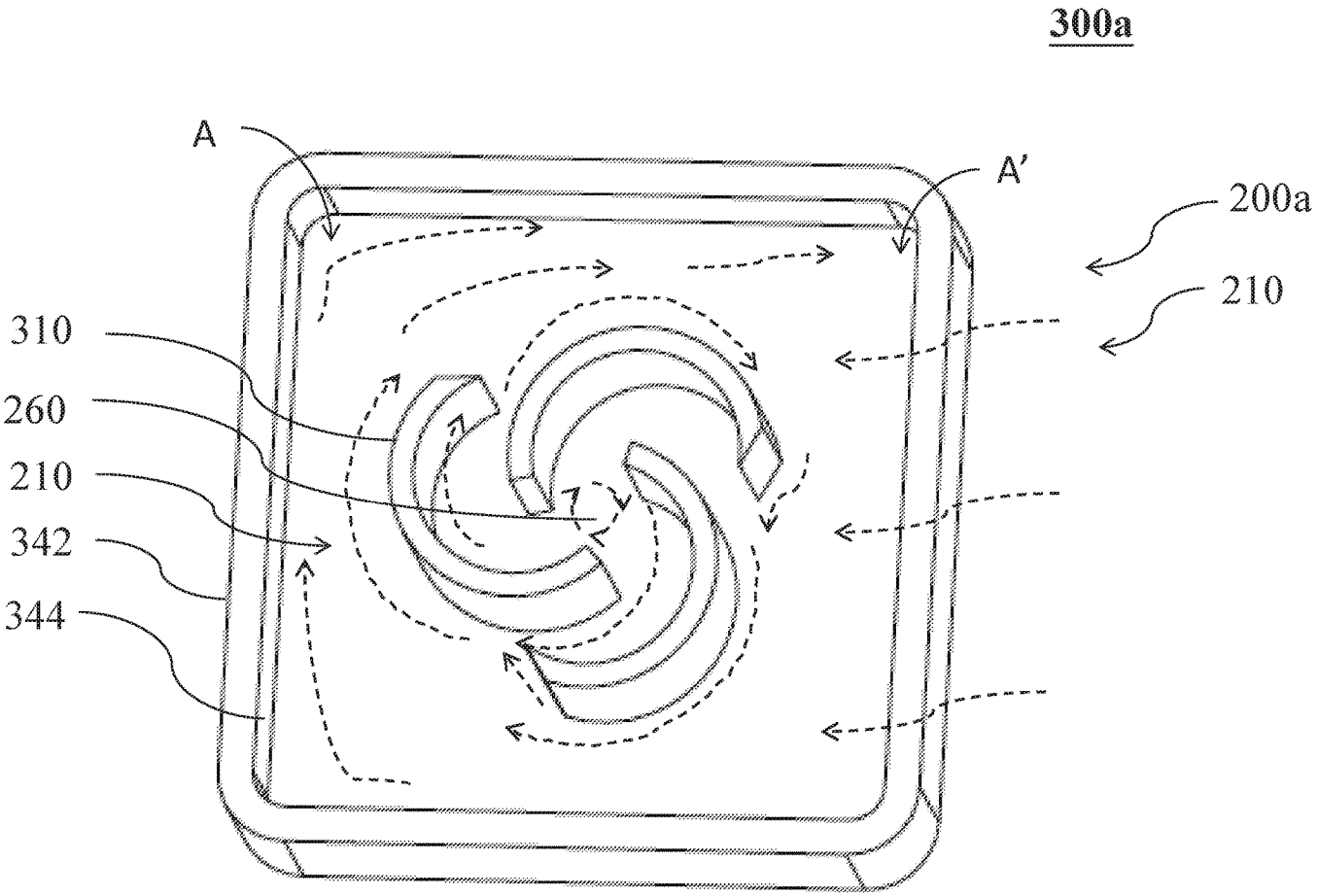
FIG. 4 is a plan view schematically illustrating a blending area of the blending structure in accordance with another embodiment of the present invention.

FIG. 4 is a plan view schematically illustrating a blending area 300*a* of the blending structure 200*a* in accordance with another embodiment of the present invention. When the reaction cassette swings toward the right side and is presented as A' relatively higher than A, the liquid of the turbulent layer and part of transition layer flows toward A due to gravity. As the liquid 210 impacts the spill-proof wall, the spill-proof wall generates an anti-gravity force forcing flow orientation of the turbulent layer toward point A'. The turbulent layer flows back to point A' causing confliction of the flow rate and flow orientation generating a vortex phenomenon 260 which is created in the vicinity of the second barrier wall. Other liquids of part of the transition layer and the viscous layer accelerate and impact the reagent (not shown) within the blending structure and flow toward the inner wall 344 adjacent to the point A. The blending structure 200*a* of some embodiments of the present invention comprises at least one arcuate blade 310. In addition to flowing toward the inner wall 344 adjacent to the point A, the liquid 210 will flow in arcuate along arcuate blade 310 due to shear stress and cohesion force affecting the liquid. Therefore, not only will part of the liquid generate the vortex phenomenon 260 in the vicinity of the outer wall 342 of the blending structure 200*a*, but it will also generate the vortex phenomenon 260 in the center of the arcuate blade structure 310. When the reaction cassette reverses and is presented as A' relatively lower than A, the direction of liquid flow is opposite to the direction of the vortex 260.

Figure 5:
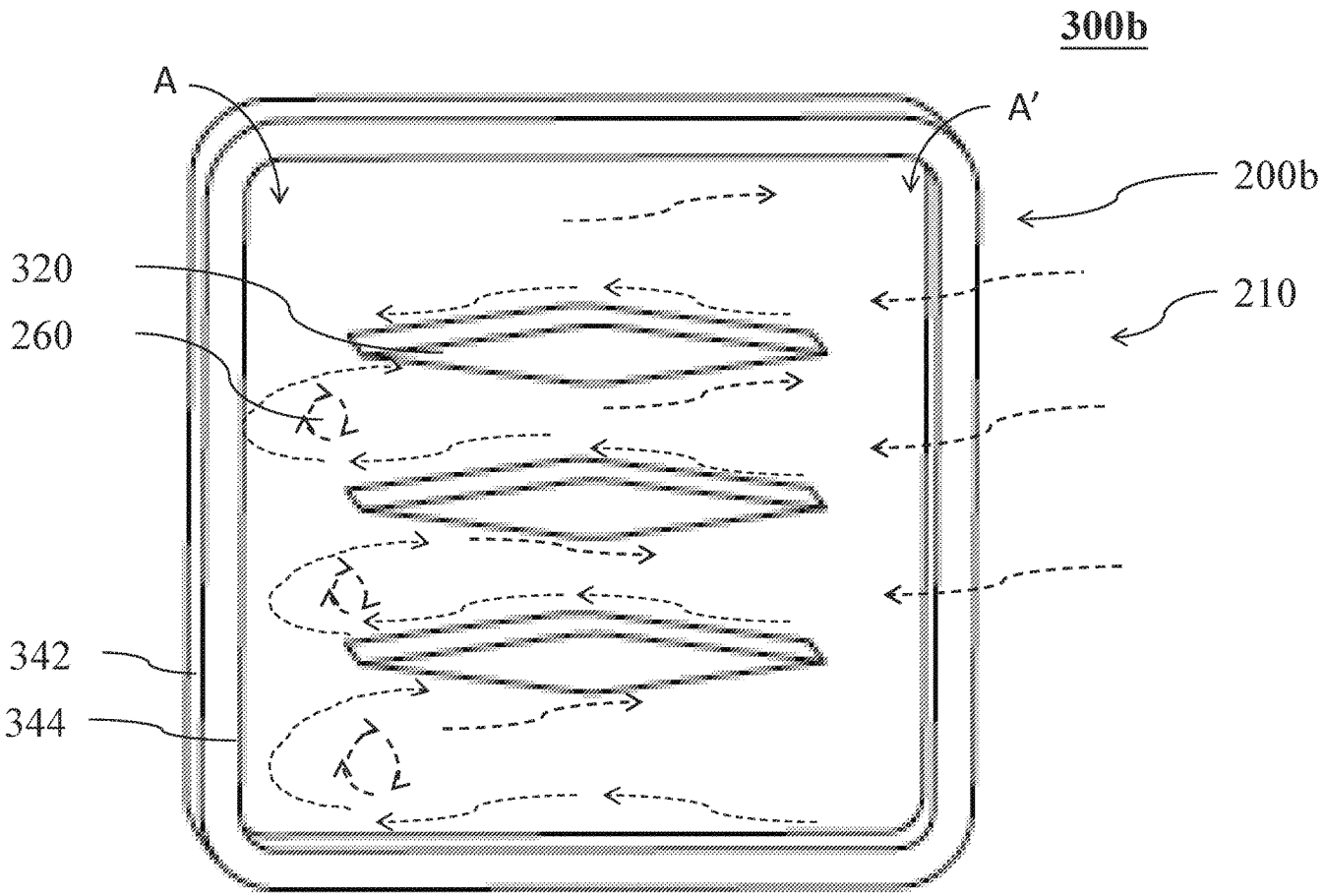
FIG. 5 is a plan view schematically illustrating a blending area of the blending structure in accordance with another embodiment of the present invention.

FIG. 5 is a plan view schematically illustrating a blending area 300*b* of the blending structure 200*b* in accordance with another embodiment of the present invention. When the reaction cassette swings toward the right side and is presented as A' relatively higher than A, the liquid 210 of the turbulent layer and part of transition layer flows toward A due to gravity. As the liquid 210 impacts the spill-proof wall, the spill-proof wall generates an anti-gravity force forcing flow orientation of the turbulent layer toward point A'. The turbulent layer flows then back to point A' causing confliction of the flow rate and flow orientation generating a vortex phenomenon 260 which is created in the vicinity of the second barrier wall. Other liquid of part of the transition layer and the viscous layer accelerate and impact the reagent (not shown) within the blending structure 200*b* and flow toward the inner wall 344 adjacent to the point A. The blending structure 200*b* of some embodiments of the present invention comprises at least one diamond-shaped blade 320. The diamond-shaped blade 320 guides flow of the liquid 210 in tilt, presenting non-horizontal linear flow in the transition layer. After impinging the inner wall 344, the liquid of the transition layer turn back toward point A. The turn-back liquid and other liquid have differences in flow rate and flow orientation due to an active force generated from striking the inner wall 344. Therefore, not only will part of the liquid generate the vortex phenomenon 260 in the vicinity of the outer wall 342 of the blending structure 200*b*, but it will also generate the vortex phenomenon 260 in the rear end of the diamond-shaped blade 320. Moreover, the diamond-shaped blade 320 of some embodiments of the present invention can make liquid of the transition layer flowing from A' to A with an oblique angle, thereby increasing differences in flow rate and flow orientation and enhancing energy of the vortex phenomenon 260. When the reaction cassette reverses and is presented as A' relatively lower than A, the direction of liquid flow is opposite to the direction of the vortex.

Figure 6:
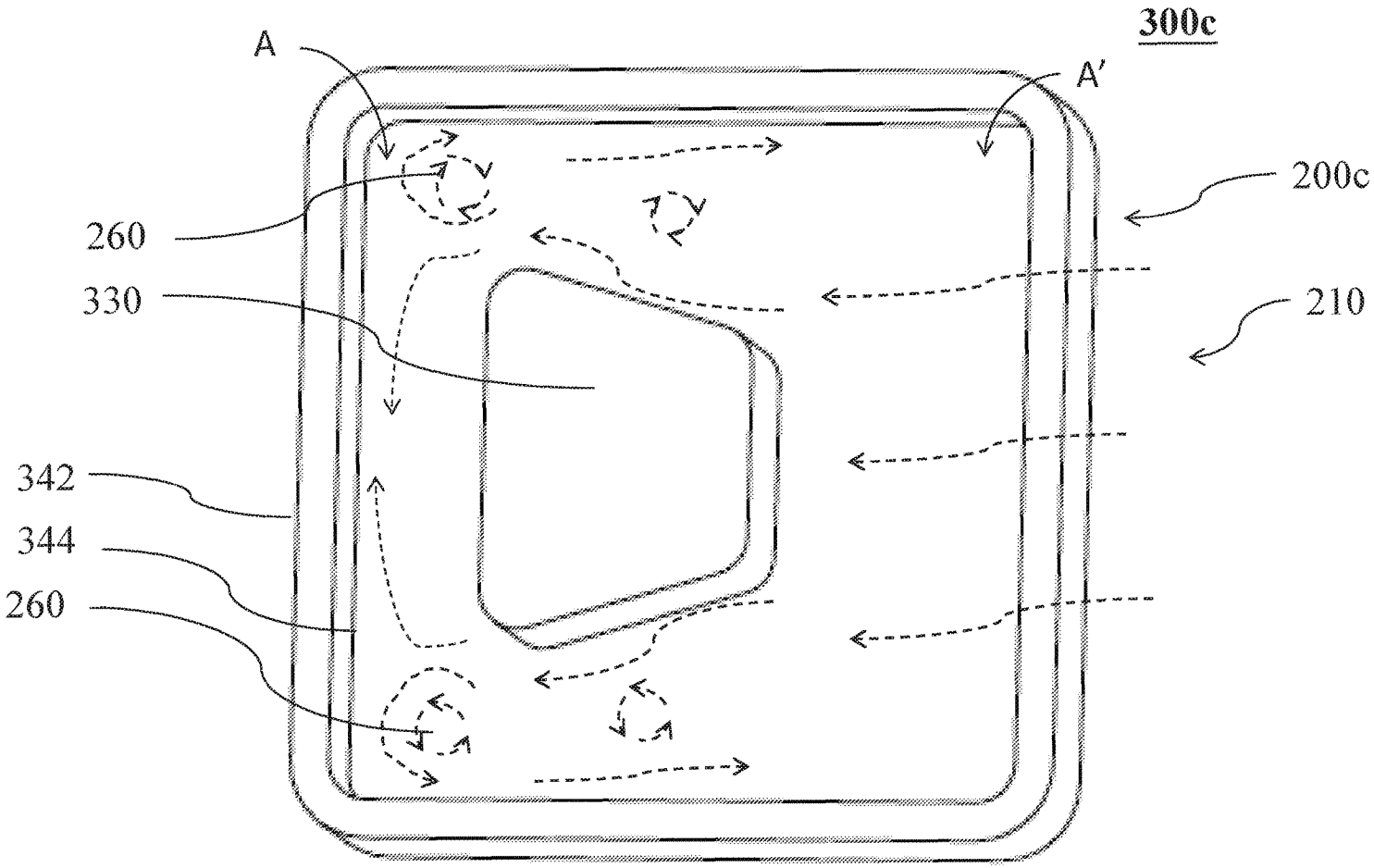
FIG. 6 is a plan view schematically illustrating a blending area of the blending structure in accordance with another embodiment of the present invention.

FIG. 6 is a plan view schematically illustrating a blending area 300*c* of the blending structure 200*c* in accordance with another embodiment of the present invention. When the reaction cassette swings toward the right side and is presented as A' relatively higher than A, the liquid 210 of the turbulent layer and part of transition layer flows toward A due to gravity. As the liquid 210 impacts the spill-proof wall, the spill-proof wall generates an anti-gravity force forcing flow orientation of the turbulent layer toward point A'. The turbulent layer flows back to point A' causing confliction of the flow rate and flow orientation generating a vortex phenomenon 260 which is created in the vicinity of the second barrier wall. Other liquid of part of the transition layer and the viscous layer accelerates and impacts the reagent (not shown) within the blending structure 200*c* and flows toward the inner wall 344 adjacent to the point A. The blending structure 200*c* of some embodiments of the present invention comprises at least one trapezoidal blade 330. The trapezoidal blade 330 guides flow of the liquid 210 in gradient alone its structure. Therefore, the transition layer and the viscous layer present non-horizontal linear flow. After impinging the inner wall, the liquid of the transition layer and the viscous layer turn back toward point A'. The turn-back liquid and other liquids create a difference in flow rate due to an active force generated from striking the inner wall 344, therefore generating the vortex phenomenon 260. In addition, the turn-back flow of the transition layer and the viscous layer moves toward point A' alone the inner wall 344, thereby generating vortex phenomenon 260 at both sides of the trapezoidal blade 330. When the reaction cassette reverses and is presented as A' relatively lower than A, the direction of liquid flow is opposite to the direction of the vortex.

Note that the shape of the blending structure of the present invention do not be intended to be limited, as it can be a square shape in FIGS. 3 to 6. The blending structure can also be geometrically adjusted according to component layout of the reaction cassette and requirements for measurement. The shape of outer wall of the blending structure can be, but not limited to: circular, elliptical, fan-shaped, arcuate, triangular, trapezoidal, oblong, rhombus, rectangle, harrier-shaped, polygonal and the likes.

Figure 7A:
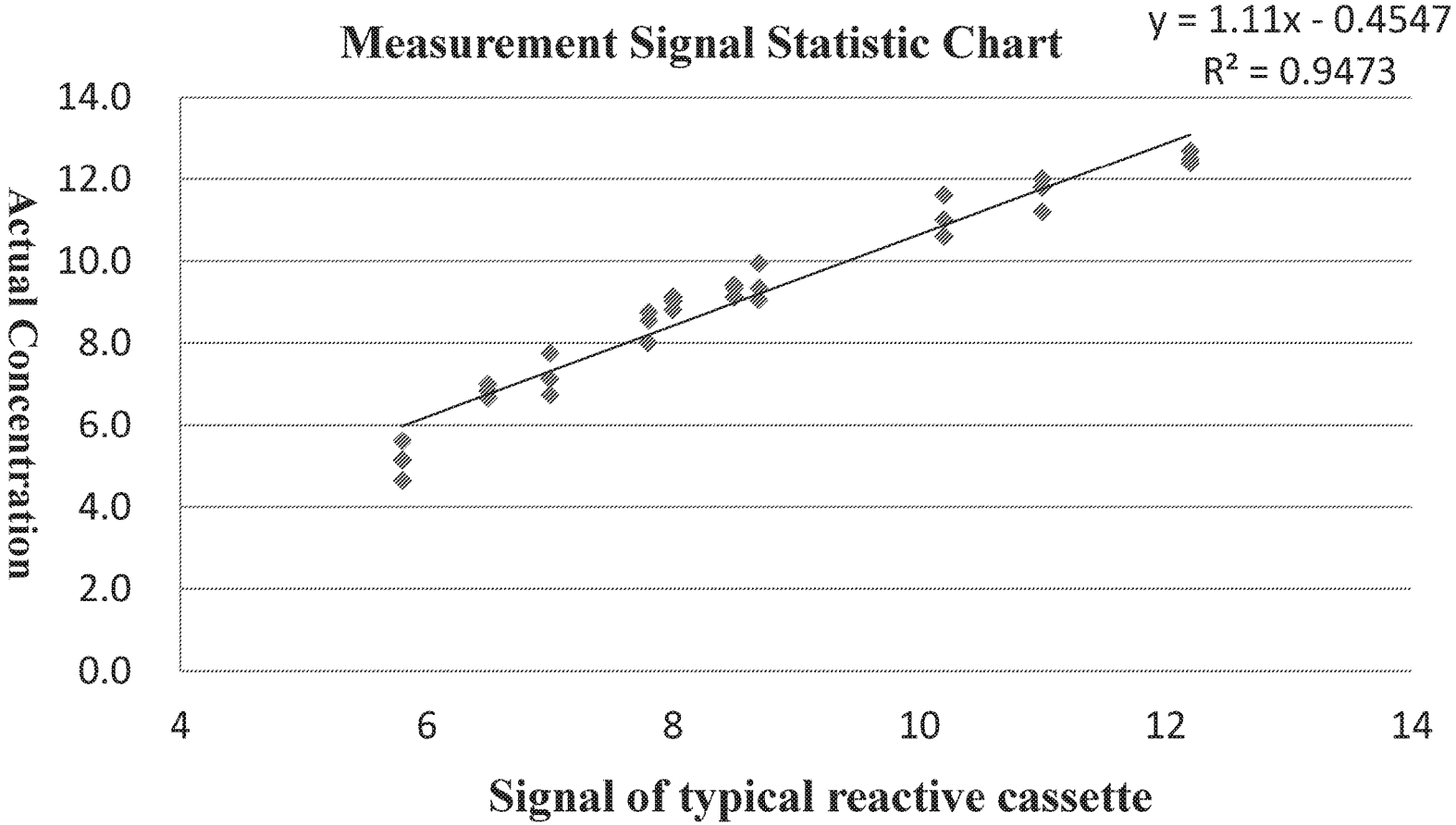
FIGS. 7A and 7B are statistic chart illustrating measuring signals by the reaction cassette.
Figure 7B:
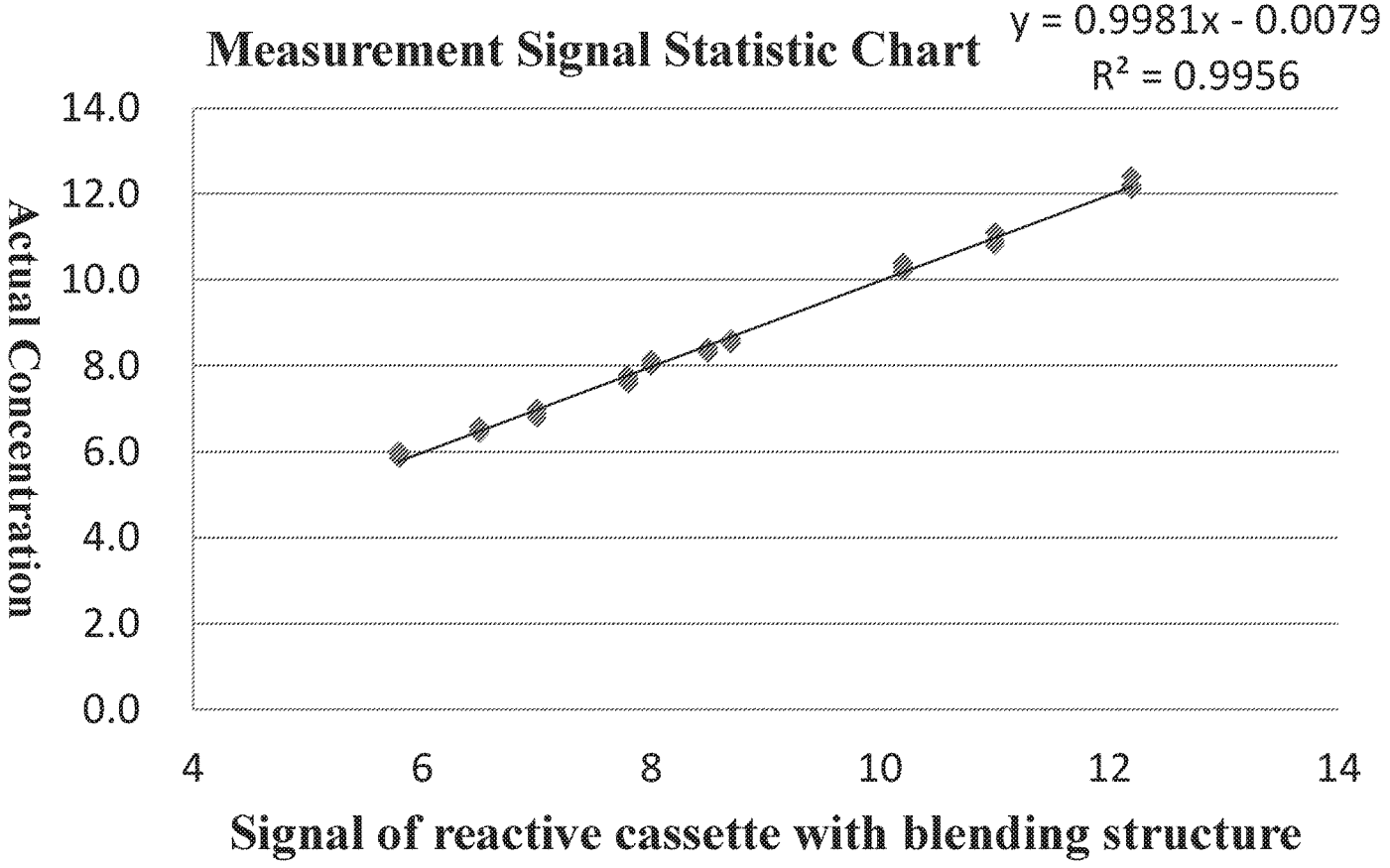

FIGS. 7A and 7B are statistic chart illustrating measuring signals by the reaction cassette. The inventors use the reaction cassettes without and with blending structures of the present invention performing some statistic concentration measurements respectively. As shown in FIG. 7A, the reaction cassette without the blending structure results in a large amount of measuring errors, while the $R^2$ value using the reaction cassette with the blending structures of the present invention is 0.995 as indicated in FIG. 7B. Since the vortex phenomenon presented the liquid is created by the blending structure in accordance with embodiments of the present invention and the vortex phenomenon can easily make the sample uniformly mixed with the reagent, a high-precision measurement structure can thus be obtained.

The above illustration is for preferred embodiments of the present invention, is not limited to the claims of the present invention. Equivalent amendments and modifications without departing from the spirit of the invention should be included in the scope of the following claims.

What is claimed is:

1. A reaction cassette for biochemical assay, comprising:

a housing with structural walls defining a liquid mixing space for accommodating at least one mixing zone;

wherein the at least one mixing zones comprises at least one blending structures for generating a vortex phenomenon in liquid, thereby improving the degree of mixture of a liquid sample and a dried reagent, and wherein the liquid mixing space comprises:

a first mixing zone configured to accommodate a liquid, having rounding edges and corners, leading the liquid to an optical detection zone;

a second mixing zone disposed in a direction perpendicular to the first mixing zone;

a first inclined plane disposed between the optical detection zone and the first mixing zone so that the liquid smoothly flows through;

a third mixing zone disposed in a direction perpendicular to the second mixing zone;

a second inclined plane disposed between the second and the third mixing zones so that the liquid smoothly flows through; and an absorption zone disposed downstream of the third mixing zone, having a spill-proof wall disposed between the third mixing zone and the absorption zone, preventing the mixed liquid in the third mixing zone from overflowing into the absorption zone accident by accident.

2. The reaction cassette according to claim 1, wherein the reaction cassette is made of materials with optical grade transparency.

3. The reaction cassette according to claim 1, wherein the absorption zone includes a hollowed, non-densified structure with openings located below the absorption zone, thereby facilitating absorption of the sample and reagents by an absorbent material.

4. The reaction cassette according to claim 3, wherein the absorbent material comprises materials having high absorbency, comprising cotton, sponges, diatomite, and filter paper.

5. The reaction cassette according to claim 1, wherein the blending structure comprises a first barrier wall, a second barrier wall, a structural wall and a spill-proof wall.

6. The reaction cassette according to claim 5, wherein the first and second barrier walls comprise a beveled outer wall, an inner wall, and a wall peak platform.

7. The reaction cassette according to claim 6, wherein the width of the wall peak platform is about 0.25~6 mm.

8. The reaction cassette according to claim 6, wherein the beveled outer wall and the structural wall include 5 to 80 degrees.

9. The reaction cassette according to claim 5, wherein the blending structure further comprises at least one arcuate blade, generating an arcuate flow of the liquid in accordance with its structure so that part of the liquid creates the vortex phenomenon in the center of the arcuate blade.

10. The reaction cassette according to claim 5, wherein the blending structure further comprises at least one diamond-shaped blade, generating an inclined flow of the liquid in accordance with its structure so that part of the liquid creates the vortex phenomenon due to a flow rate difference between a turn-back liquid and other liquid.

11. The reaction cassette according to claim 5, wherein the blending structure further comprises at least one trapezoidal blade, generating an inclined flow of the liquid in accordance with its structure so that part of the liquid creates a vortex phenomenon due to a flow rate difference between a turn-back liquid and other liquid.

12. The reaction cassette according to claim 1, wherein the shape of an outer wall of the blending structure comprises: circular, elliptical, fan-shaped, arcuate, triangular, trapezoidal, oblong, rhombus, rectangle, harrier-shaped, and polygonal.

13. A biochemical assay device, comprising:

a reaction cassette for biochemical assay as claimed in claim 1;

a sampling part configured to be coupled to the reaction cassette, comprising:

a sampling tube configured to draw a liquid sample; and a reservoir configured to store a liquid reagent.

* * * * *